United States Patent [19]

Allen

[11] 3,978,926

[45] Sept. 7, 1976

[54] RECOVERY OF BITUMENS BY IMBIBITION FLOODING

[75] Inventor: Joseph C. Allen, Bellaire, Tex.

[73] Assignee: Texaco Inc., New York, N.Y.

[22] Filed: May 19, 1975

[21] Appl. No.: 578,560

[52] U.S. Cl. ..... 166/267; 166/305 R; 299/5

[51] Int. Cl.[2] ..... E21B 43/00

[58] Field of Search..... 166/267, 272, 303, 305 R, 166/306, 274; 299/5

[56] References Cited

UNITED STATES PATENTS

| | | | |
|---|---|---|---|
| 2,288,857 | 7/1942 | Subkow | 166/272 |
| 2,882,973 | 4/1959 | Doscher et al. | 166/305 R |
| 3,279,538 | 10/1966 | Doscher | 166/272 |
| 3,349,850 | 10/1967 | Schlicht et al. | 166/267 |
| 3,379,247 | 4/1968 | Santourian | 166/272 |
| 3,386,513 | 6/1968 | Holmes | 166/267 |
| 3,811,506 | 5/1974 | Carlin | 166/305 R |
| 3,881,551 | 5/1975 | Terry et al. | 166/272 |

*Primary Examiner*—Ernest R. Purser
*Assistant Examiner*—Jack E. Ebel
*Attorney, Agent, or Firm*—T. H. Whaley; C. G. Ries; Charles L. Bauer

[57] ABSTRACT

A method for recovering bitumen from tar sand deposits by imbibition flooding at ambient temperature wherein the bitumen is sequentially contacted with a paraffin liquid hydrocarbon followed by a soak period to allow imbibition of the solvent, after which the bitumen and solvent mixture is produced, and the cycle is repeated.

6 Claims, 1 Drawing Figure

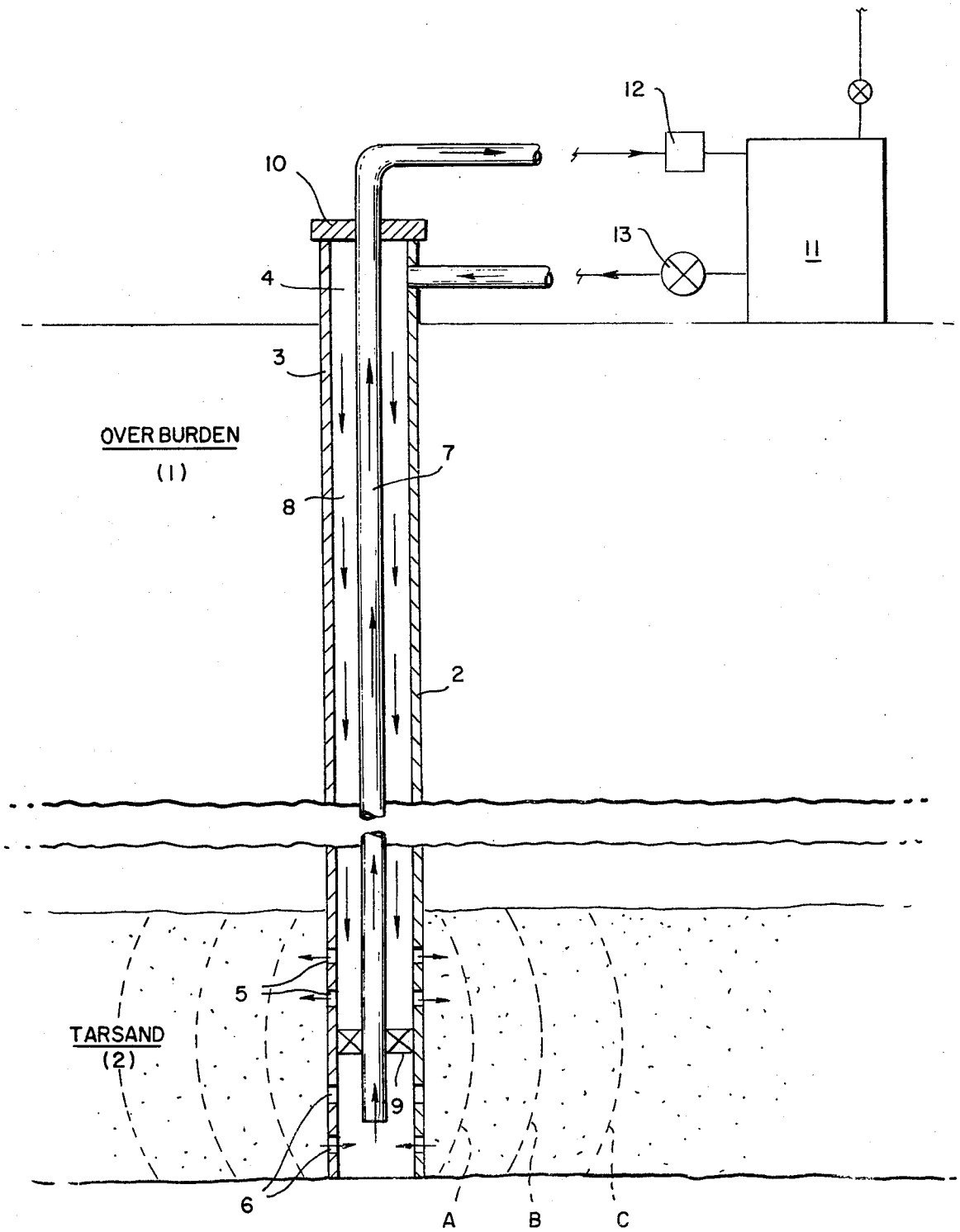
12
10
13
11
4
3
OVER BURDEN
(1)
7
8
2
5
TARSAND
(2)
9
6
A
B
C

RECOVERY OF BITUMENS BY IMBIBITION FLOODING

BACKGROUND OF THE INVENTION

This invention relates to the in-situ recovery of bitumen from tar sands by imbibition flooding with a paraffin liquid hydrocarbon.

DESCRIPTION OF THE PRIOR ART

The recovery of bitumen from tar sands by conventional methods of production has generally been difficult because of the high viscosity and the low mobility of the bitumen at formation temperature. Vast quantities of tar sands are known to exist as for example in the Athabasca region of Alberta, Canada. These Alberta deposits are estimated to contain several billion barrels of oil or bitumen which are contained in unconsolidated formations, that is, formations in which the sand or matrix has no continuity and occurs as mostly separated particles surrounded by reservoir fluids. The hydrocarbon in the tar sand deposit is an asphaltic bitumen of a highly viscous nature ranging from a liquid to a semi-solid. Bitumen can be regarded as highly viscous oils having a gravity in the range of about 5° to 10° API. The reservoirs in which they occur generally lack any substantial sources of natural driving energy such as a water or gas drive.

Where surface mining is not feasible the bitumen must be recovered in-situ wherein methods are employed to reduce the viscosity and improve the mobility of the bitumen. The in-situ methods employed include thermal methods, such as steam or in-situ combustion, and solvent methods.

Generally the thermal methods have not been too successful since long periods of time and considerable amounts of thermal energy are required to heat up the formation sufficiently to obtain the desired reduction in viscosity and improved mobility. In addition, additional problems arise because of the fact that the permeability of the formations is so low that difficulty has been experienced in establishing fluid communication within the formation.

Methods that have been used to improve the permeability include the use of solvents, such as aromatic hydrocarbons that dissolve the bitumen and wash it out of the matrix. These solvents have been employed in in-situ push-pull techniques whereby the solvent is injected via one well and production occurs later via the same well by back flowing and producing the well. Generally these methods are not economical because of the high cost of the solvent. Throughput operations employing a solvent slug followed by a drive agent such as water have also been shown to be not economical because of the very poor sweep efficiencies that occur.

SUMMARY OF THE INVENTION

The invention relates to a method for extracting bitumen in-situ from tar sands by sequentially contacting the tar sand deposit with a paraffin liquid hydrocarbon for a sufficient time to allow imbibition of the solvent into the tar sand followed by production of the solvent and dissolved bitumen mixture.

BRIEF DESCRIPTION OF THE DRAWING

The drawing depicts a typical embodiment of the imbibition recovery process using a single well.

DESCRIPTION OF THE PREFERRED EMBODIMENT

The prior art as taught in U.S. Pat. No. 3,811,506 employs the use of aromatic hydrocarbon solvents such as benzene, toluene, xylene and highly aromatic mixtures of hydrocarbons in imbibition flooding since these materials are recognized as solvents for the tar sands without precipitating their asphaltic constituents. After imbibition has occurred, an aqueous fluid is introduced into the formation which is also allowed to imbibe into the tar sand deposit. Thereafter, the fluids - aqueous fluid, solvent and bitumen - are produced by conventional means via the same well.

I have now found surprisingly that a paraffin liquid hydrocarbon such as n-pentane is excellent as a solvent for bitumen and in fact superior in some cases to aromatic hydrocarbons for extracting bitumen. This finding was unexpected since the paraffins are known to precipitate the asphaltic components of the bitumen. The effectiveness of the use of paraffin hydrocarbons can be shown in the following tests wherein n-pentane was used to extract bitumen by capillary imbibition and gravity drainage. In demonstrating the invention in the laboratory, a recovery of 92% was obtained by sequential contacting and extraction of bitumen from a Utah tar sand permeability plug. In the test the plug was placed in a jar, n-pentane was added to bring the level to ¼ inch above the bottom of the plug, and the jar was then closed and left for 24 hours. Rapid imbibition of the pentane occurred and simultaneously therewith bitumen extraction occurred by gravity drainage. The following table shows the recovery by sequential extraction:

| Extraction No. | % Recovery |
|---|---|
| 1 | 59 |
| 2 | 71 |
| 3 | 80 |
| 4 | 83 |
| 5 | 87 |
| 6 | 88 |
| 7 | 92 |
| 8 | 92 |

The results show that the bitumen-containing core rapidly and spontaneously imbibed the paraffin liquid hydrocarbon, which very effectively extracted substantially all of the bitumen by capillary imbibition and gravity drainage in a series of sequential extractions.

Any paraffin liquid hydrocarbon can be used as the solvent providing it has a low viscosity and low molecular weight. Preferred hydrocarbons are normal paraffins having from 3 to 7 carbon atoms per molecule that are liquid at formation conditions. In particular, n-pentane has been found to be very effective.

A typical embodiment of my invention for recovery of bitumen from tar sands by imbibition and a series of sequential extractions using a paraffin liquid hydrocarbon is illustrated in the accompanying figure. A well is drilled through the overburden 1 and traverses the tar sand formation 2. Casing 3 is run into the wellbore 4 and cemented to surface. The casing traverses the tar sand formation and is perforated in two intervals shown by perforations 5 and 6, thereby forming a first and second set of perforations. Thereafter, tubing 7 is inserted into the casing to a depth intermediate between the two sets of perforations thus creating an annulus 8 between the casing 3 and the tubing 7. A packer 9 is then set in the annulus positioned intermediate between the two sets of perforations, that is, above perforation 6 and below perforation 5. The lower end of the tubing is open to and in communication with the lower portion of formation via perforation 6. Communication between the annulus and the upper portion of the formation occurs via perforations 5. Suitable means 10 are provided to complete the well at the surface.

Surface equipment is provided for containing and cycling the paraffin liquid solvent employed. The equipment includes a reservoir tank 11 containing the solvent, a pump 12, and a valve 13 with suitable connecting piping means.

In operation, valve 13 in the line connecting the reservoir tank with the annulus, is opened, and solvent from the tank is allowed to flow by gravity down the annulus into the formation via perforations 5 where it is imbibed into the tar sand formation. In order to inject the solvent into the formation, particularly if the formation has very low permeability, fracturing may be required. If fracturing is undertaken, the solvent is injected into the formation along the lines of fracture. Imbibition of the solvent occurs by allowing for a soak period whereby the bitumen adjacent the wellbore, as shown by position A in the figure, is dissolved by the paraffin hydrocarbon solvent. The solvent-bitumen mixture collects by gravity drainage in the lower portion of the formation, that is in communication with the tubing 7 via perforations 6. After the soak period, the solvent-bitumen mixture is pumped up tubing 7 by means of pump 12 and into the reservoir tank 11. If preferred the pump can be positioned in the wellbore near the bottom of the well.

The solvent-bitumen mixture in the tank is then again allowed to flow via the annulus and into the formation, thereby contacting a fresh area of tar sand containing bitumen, for example, position B in the figure. After a soak period the mixture enriched by additional bitumen is again pumped to the reservoir tank. The injection, soak, production cycle is again repeated so as to effect bitumen recovery from position C. This cycle is repeated so that the mixture is contacted sequentially with new positions of the formation until the solvent has become highly diluted with bitumen and additional solution of bitumen in the mixture is minimal. The mixture from the tank is then treated by means not shown to separate the bitumen and solvent to recover the bitumen. The recovered solvent is available for further imbibition of bitumen in-situ by the method of sequential extraction as set forth above.

It is within the scope of the invention to employ additional wells in a pattern arrangement wherein each well undergoes the sequential extraction of bitumen. The operation is continued for each well so as to effect ever increasing areas of the formation out from each wellbore and until solvent breakthrough occurs and fluid communication is established between the wells. Thereafter, a throughput operation may be initiated utilizing one well as a solvent injection well and the offset wells as production wells.

It is also within the scope of the invention to follow the sequential extraction using a paraffin liquid hydrocarbon with the injection of an aqueous fluid following the teachings of U.S. Pat. No. 3,811,506. The aqueous fluid may contain surfactants that improve the surface active properties of the aqueous fluid so as to disperse, solubilize, wet or emulsify the bitumen and thus aid in its recovery.

By using the imbibition technique as set forth herein, a small amount of a paraffin liquid hydrocarbon is utilized to produce a large amount of bitumen from tar sands.

Other modifications and variations of the invention as hereinbefore set forth may be made without departing from the spirit and scope thereof, and therefore, only such limitations should be imposed as are indicated in the appended claims.

I claim:

1. A method for in-situ recovery of bitumen from tar sand deposits by sequential extraction at ambient temperature deposit comprising the steps of;

a. contacting a portion of said tar sand deposits with a paraffin liquid hydrocarbon solvent,
b. allowing said solvent to remain in contact with said portion of said tar sand deposit and imbibe into said deposit thereby dissolving said bitumen,
c. producing said bitumen and solvent mixture,
d. again contacting said tar sand deposit with said mixture to dissolve additional bitumen,
e. producing said mixture,
f. repeating steps (d) and (e) until said bitumen and solvent mixture becomes highly diluted with said bitumen,
g. separating said bitumen from said mixture thereby recovering said bitumen.

2. A method as in claim 1 wherein said solvent is injected via a wellbore traversing said tar sand deposit and thereafter said solvent and bitumen mixture are produced via the same wellbore.

3. A method as in claim 1 wherein the solvent is a paraffin hydrocarbon having from 3 to 7 carbon atoms per molecule and which is a liquid at deposit conditions.

4. A method as in claim 1 wherein said solvent is n-pentane.

5. A method as in claim 1 wherein an aqueous fluid is injected after imbibition by said solvent of the tar sand has occurred.

6. A method as in claim 1 wherein said aqueous fluid contains a surfactant.

* * * * *